US006253715B1

(12) United States Patent
Takubo et al.

(10) Patent No.: US 6,253,715 B1
(45) **Date of Patent: *Jul. 3, 2001**

(54) WATER-TUBE BOILER

(75) Inventors: Noboru Takubo; Takanori Tanaka, both of Matsuyama (JP)

(73) Assignees: Miura Co., Ltd.; Miura Institute of Research & Development Co., Ltd., both of Ehime-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/560,964

(22) Filed: Apr. 28, 2000

(30) Foreign Application Priority Data

Apr. 30, 1999 (JP) ..... 11-123577

(51) Int. Cl.[7] ..... F22B 21/00

(52) U.S. Cl. ..... 122/235.11; 122/235.23; 122/367.1; 122/6 A

(58) Field of Search ..... 122/235.11, 235.23, 122/367.1, 367.2, 367.3, 7 R, 6 A, 18.4

(56) References Cited

U.S. PATENT DOCUMENTS

| | | | | |
|---|---|---|---|---|
| 3,633,550 | | 1/1972 | Kraus . | |
| 4,257,358 | | 3/1981 | Watanabe . | |
| 4,453,496 | | 6/1984 | Yoshinari . | |
| 4,825,813 | | 5/1989 | Yoshinari et al. . | |
| 5,020,479 | | 6/1991 | Suesada et al. . | |
| 5,199,384 | | 4/1993 | Kayahara et al. . | |
| 5,273,001 | | 12/1993 | Kayahara et al. . | |
| 5,353,748 | | 10/1994 | Kayahara et al. . | |
| 6,116,196 | * | 9/2000 | Watanabe et al. | 122/235.11 |

FOREIGN PATENT DOCUMENTS 60-78247 5/1985 (JP) .

* cited by examiner

*Primary Examiner*—Jiping Lu

(57) ABSTRACT

A water-tube boiler which allows further $NO_x$ reduction and CO reduction to be implemented with an uncomplicated construction of the boiler body itself, and which is improved in boiler efficiency. The water-tube boiler includes a first water tube array made up of a plurality of first water tubes arranged into an annular shape and a combustion chamber inside the first water tube array.

7 Claims, 5 Drawing Sheets

WATER-TUBE BOILER

BACKGROUND OF THE INVENTION

The present invention relates to water-tube boilers such as once-through boilers, natural circulation water-tube boilers and forced circulation water-tube boilers.

The water-tube boiler includes body of which is made up by water tubes. The body arrangement of such a water-tube boilers, for example, that a plurality of water tubes are arranged into an annular shape. In the water-tube boiler of this form, a cylindrical space surrounded by the annular water tube array is used as a combustion chamber. In such a water-tube boiler, heat transfer primarily by radiation is performed within the combustion chamber, and then heat transfer primarily by convection is done in the downstream of the combustion chamber.

In recent years, such water-tube boilers are also desired to be further reduced in NOx and CO. The reduction in NOx, as it stands now, is implemented by fitting low-NOx burners or exhaust-gas re-circulation equipment to the existing boiler bodies. The reduction in CO is implemented by adjusting the state of combustion of the combustion equipment. However, further reduction in NOx and reduction in CO are demanded in keeping up with growing recognitions of environmental issues.

Also, there has been a demand for improvement in boiler efficiency for the purpose of reduction in running cost.

As it stands, such measures as increasing in heat transfer area by providing heat transfer fins in the water tubes, or performing heat recovery from exhaust gas by installing a feed-water preheater. However, for further promotion of energy saving, further improvement in boiler efficiency is demanded.

An object of the invention is to achieve further reduction in NOx and reduction in CO with a simple structure of the boiler body itself and also to achieve further improvement in boiler efficiency.

In order to achieve the above object, the present invention provides a water-tube boiler comprising: a first water tube array made up of a plurality of first water tubes arranged into an annular shape; a combustion chamber defined inside the first water tube array; a first opening defined at part of the first water tube array; a cooling water tube array made up of a plurality of cooling water tubes arranged into an annular shape in a zone within the combustion chamber where burning-reaction ongoing gas is present; gaps provided between adjacent cooling water tubes so as to permit the burning-reaction ongoing gas to flow through; a burning-reaction continuing zone, where burning reaction is continuously effected, provided between the cooling water tube array and the first water tube array; a second water tube array made up of a plurality of second water tubes arranged into an annular shape outside the first water tube array; a second opening defined at part of the second water tube array; and a gas flow passage provided between the first water tube array and the second water tube array, wherein in the gas flow passage, heat transfer area per unit space is larger on the downstream side than on the upstream side.

In an embodiment of the invention, the water-tube boiler is characterized in that in the gas flow passage, heat transfer fins are provided on heat transfer surfaces on the downstream side while the heat transfer fins are not provided on heat transfer surfaces on the upstream side.

In an embodiment of the invention, the water-tube boiler is characterized in that in the gas flow passage, heat transfer fins are provided on at least one of the first water tubes and the second water tubes, and heat transfer area per water tube of the heat transfer fins on the downstream side is larger is than heat transfer area per water tube on the upstream side.

The present invention is embodied as a water-tube boiler of the multiple-tube type. Further, the water-tube boiler of the present invention is applied not only as steam boilers or hot water boilers, but also as heat medium boilers in which a heat medium is heated.

A first water tube array is made up by arranging the plurality of first water tubes into an annular shape, and a combustion chamber is defined inside this first water tube array. A first opening is provided at part of the first water tube array. This first opening may be provided as a single opening having an appropriate width in the circumferential direction, or as a plurality of openings divisionally by interveniently providing one or two first water tubes. A cooling water tube array is made up of a plurality of cooling water tubes arranged into an annular shape, in a zone within the combustion chamber where burning-reaction ongoing gas is present. Gaps are provided between adjacent cooling water tubes so as to permit the burning-reaction ongoing gas to flow through. The burning-reaction ongoing gas includes a flame, being a high-temperature gas under progress of burning reaction. That is, the cooling water tubes are placed within the flame, thus being in contact with the flame. Between the cooling water tube array and the first water tube array, a zone where burning reaction is continuously effected is provided.

Outside the first water tube array, a plurality of second water tubes are arranged in an annular shape, by which a second water tube array is constituted. Between the first water tube array and the second water tube array, is defined a gas flow passage, and this gas flow passage and the combustion chamber communicate with each other via the first opening. A second opening is provided at part of the second water tube array. This second opening may be provided as a single opening or as a plurality of openings, like the first opening. The gas flow passage communicates with the outside of the boiler via the second opening.

Heat transfer area per unit space (so-called heat transfer surface density) in the gas is larger on the downstream side than on the upstream side. For example, in a heat transfer surface in the gas flow passage, i.e., in a heat transfer surface of the first water tube array or the second water tube array on the gas flow passage side, heat transfer fins are provided on the heat transfer surface of the downstream side, while no heat transfer fins are provided on the heat transfer surface of the upstream side. Further, the heat transfer fins are provided on the heat transfer surface of at least one of the first water tubes and the second water tubes on the gas flow passage side, and heat transfer area of the heat transfer fins per water tube is made larger on the downstream side than on the upstream side.

An example of the concrete arrangement for changing the heat transfer area of the heat transfer fins per water tube is given below. The heat transfer fins in the circumferential direction of water tubes is made larger on the downstream side than on the upstream side. Also, the height of the heat transfer fins in a direction vertical to the circumferential surfaces of the water tubes is made larger on the downstream side than on the upstream side. Further, by changing the pitch at which the heat transfer fins are placed, the number of heat transfer fins per water tube is made larger on the downstream side than on the upstream side. These arrangements may be embodied in combination as appropriate.

Flow and reaction of the burning-reaction ongoing gas within the combustion chamber are explained in detail. Burning-reaction ongoing gas that has been generated by the fuel burning in the combustion chamber is cooled by the cooling water tubes, with the temperature lowered, by which the generation of thermal NOx is suppressed. The burning-reaction ongoing gas, which flows through the gaps between the cooling water tubes, contacts the overall surfaces of the cooling water tubes, thus being cooled. As can be explained for Zeldovich mechanism, the higher the temperature of burning reaction, the higher the generation rate of thermal NOx increases considerably; the lower the temperature of burning reaction, the lower the generation rate of thermal NOx, where the generation rate of thermal NOx is considerably lower when the temperature of burning reaction is 1400° C. or lower. Therefore, number and heat transfer area of the cooling water tubes are set in order that the temperature of burning reaction becomes 1400° C. or lower. When the cooling water tube array is made up of a plurality of water tube arrays, the heat transfer area per unit space is increased so that NOx reduction effect by cooling is improved.

The burning-reaction ongoing gas that has passed through the gaps between the cooling water tubes continues burning reaction in a zone between the cooling water tube arrays and the first water tube array, where burning reactions of intermediate products of burning reactions such as CO and HC and unburnt components of the fuel are continuously effected. Since CO remaining in the burning-reaction ongoing gas is oxidized into $CO_2$, the amount of CO emission from the boiler is reduced.

Within the combustion chamber, radiant heat transfer and convective heat transfer are effected. The gas that has nearly completed the burning reaction flows into the gas flow passage through the first opening, where convective heat transfer is primarily effected in the gas flow passage. The burning-reaction completed gas, after passing through the gas flow passage, is exhausted outside through the second opening.

The burning-reaction ongoing gas flowing through the gas flow passage lowers in temperature as a result of heat exchange with heated fluid within the first water tubes and the second water tubes. Therefore, the burning-reaction completed gas flowing through the gas flow passage decreases in volume increasingly as the gas goes further downstream, with the gas flow rate lowered, resulting in a lowered amount of heat transfer per unit heat transfer area on the downstream side. However, by making the heat transfer area per unit space larger on the downstream side than on the upstream side as described before, the amount of heat transfer on the downstream side is increased, so that the boiler efficiency is improved. Besides, proportionally to the increase in the amount of heat transfer on the down stream side, the amount of heat transfer on the upstream side can be suppressed so that overheating of the water tubes does not occur. Thus, heat loads of the first water tubes and the second water tubes are averagely balanced and the boiler durability is improved.

DETAILED DESCRIPTION OF THE PREFERRED EMBODIMENTS

Figure 1:
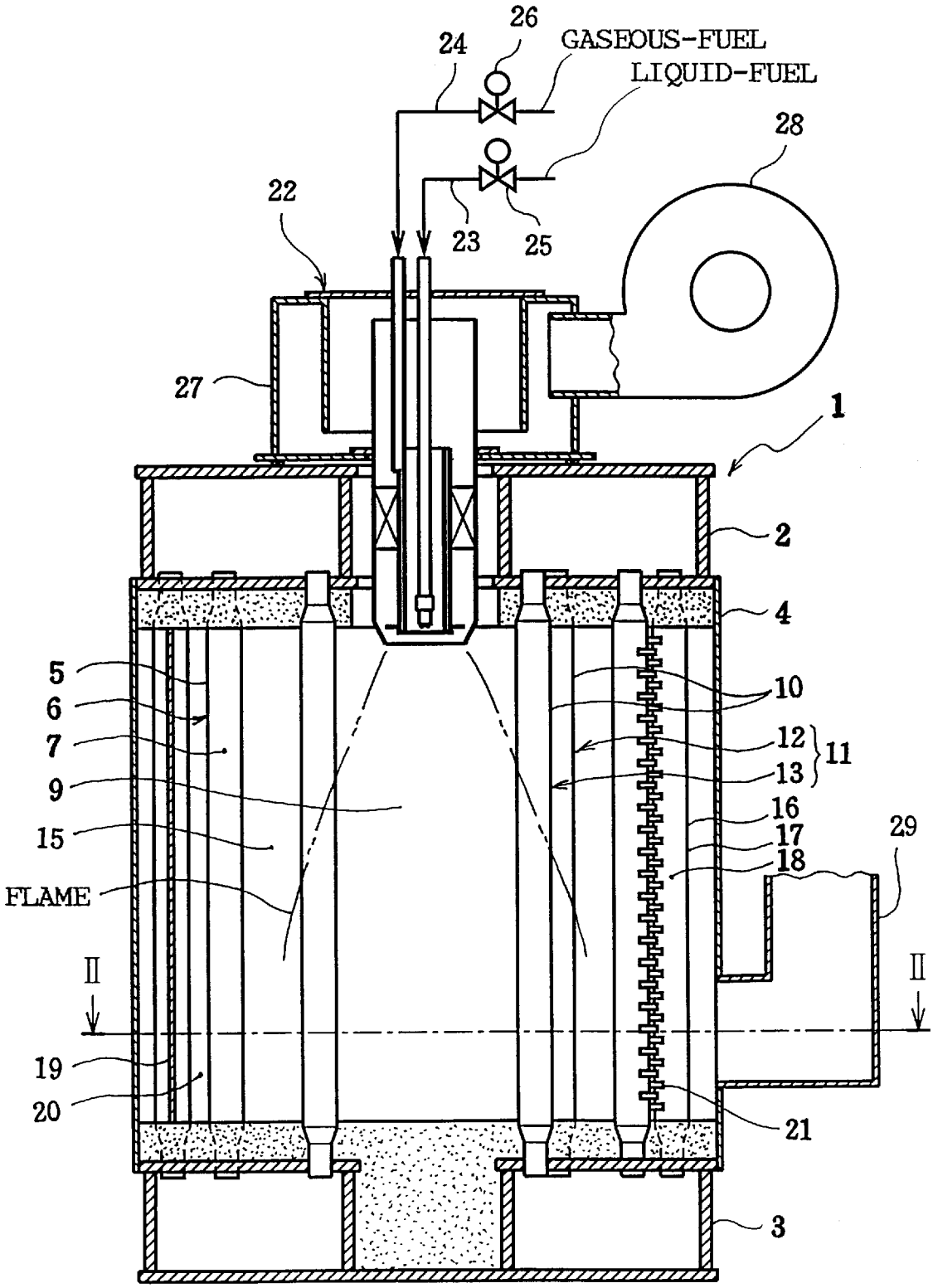
FIG. 1 is an explanatory view of a longitudinal section in a first embodiment of the invention.
Figure 2:
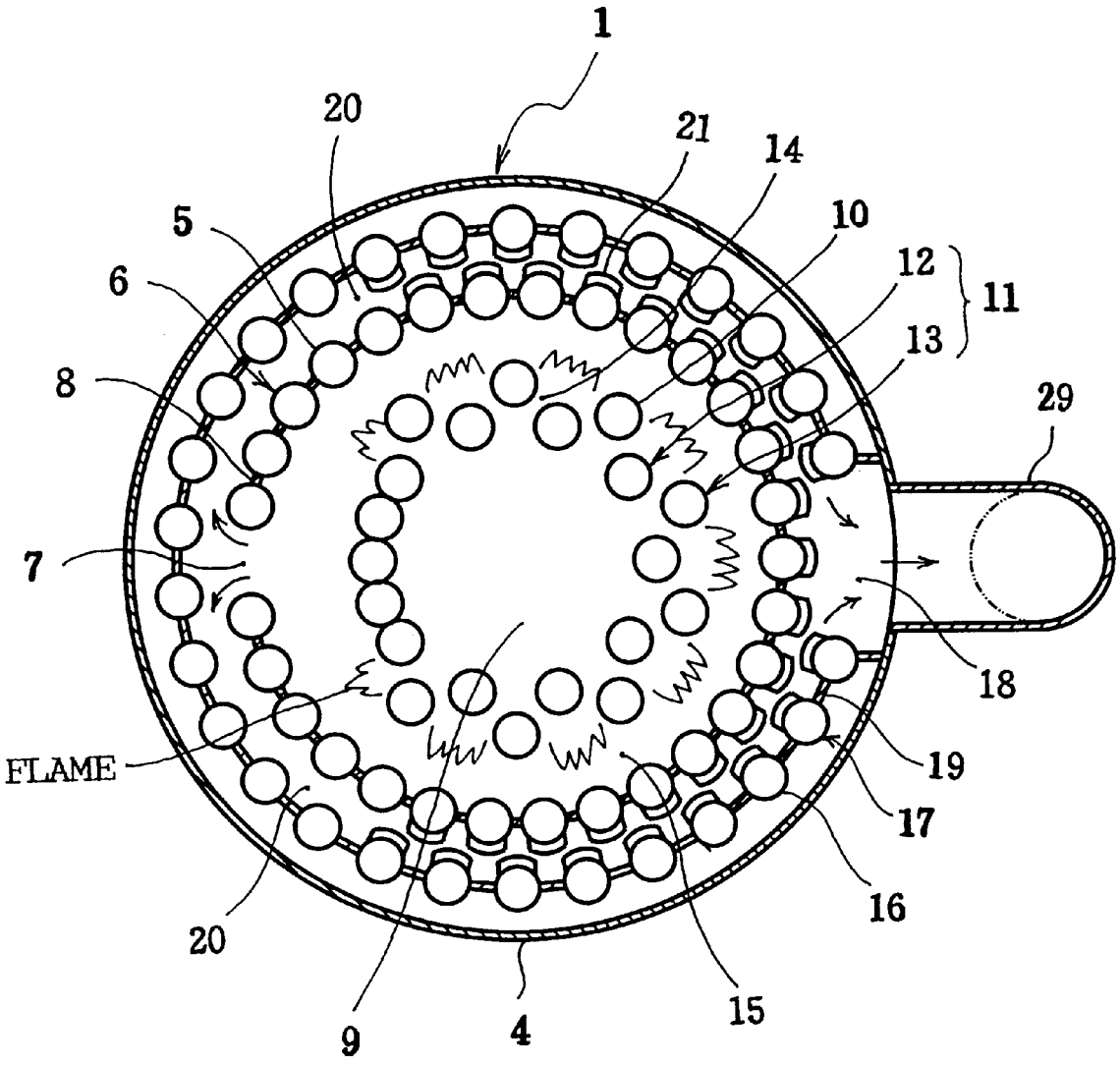
FIG. 2 is an explanatory view of a section taken along the line II—II of FIG. 1.

Hereinbelow, a first embodiment in which the present invention is applied to a multiple-tube type once-through boiler is described with reference to FIGS. 1 and 2. FIG. 1 is an explanatory view of a longitudinal section of the first embodiment of the invention, and FIG. 2 is an explanatory view of a cross section taken along the line II—II of FIG. 1.

A boiler body 1 has an upper header 2 and a lower header 3 arranged spaced from each other by a specified distance. An outer wall 4 is disposed between outer circumferences of these upper header 2 and lower header 3.

Between the upper header 2 and the lower header 3, a plurality (twenty-nine in the first embodiment) of first water tubes 5 are arranged in an annular shape. These first water tubes 5 constitute an annular first water tube array 6, and upper and lower end portions of each first water tube 5 are connected to the upper header 2 and the lower header 3, respectively. This first water tube array 6 has a first opening 7 at one portion thereof. Between the first water tubes 5 except the first opening 7, first longitudinal fin members 8, 8, . . . are provided, so that the first water tubes 5 are connected to one another by the first longitudinal fin members 8.

A combustion chamber 9 is defined inside the first water tube array 6. In a zone where burning-reaction ongoing gas is present (hereinafter, referred to as "burning reaction zone"), a plurality (twenty in the first embodiment) of cooling water tubes 10 are arranged in an annular shape. These cooling water tubes 10 constitute an annular cooling water tube array 11, and upper and lower end portions of each cooling water tube 10 are connected to the upper header 2 and the lower header 3, respectively. The cooling water tube array 11 comprises two annular water tube arrays, an inner cooling water tube array 12 and an outer cooling water tube array 13. In the inner cooling water tube array 12, a specified number (five in the first embodiment) of cooling water tubes 10 confronting the first opening 7 are placed in close contact with one another. Between adjacent cooling water tubes 10 except these cooling water tubes 10 in close-contact placement, are defined gaps 14 that permit the burning-reaction ongoing gas to flow. The cooling water tubes 10 of the outer cooling water tube array 13 are placed so as to confront the gaps 14 of the inner cooling water tube array 12, respectively, and gaps 14 that permit the burning-reaction ongoing gas to flow therethrough are defined also between the cooling water tubes 10 of the inner cooling water tube array 12 and the cooling water tubes 10 of the outer cooling water tube array 13.

A zone 15 where burning reactions of intermediate products of burning reactions such as CO and HC and unburnt components of the fuel are continuously effected (hereinafter, referred to as "burning-reaction continuing zone") is provided between the first water tube array 6 and the cooling water tube array 11. Within this burning-reaction continuing zone 15, no heat-absorbing members such as the first water tubes 5 are present.

Outside the first water tube array 6, a plurality (twenty-eight in the first embodiment) of second water tubes 16 are arranged in an annular shape. These second water tubes 16 constitute an annular second water tube array 17, and upper and lower end portions of each second water tube 16 are connected to the upper header 2 and the lower header 3, respectively. This second water tube array 17 has a second opening 18 at one portion thereof. This second opening 18 is provided about 180 degree opposite to the first opening 7 of the first water tube array 6. Between the second water tubes 16 except the second opening 18, second longitudinal fin members 19, 19, . . . are provided, so that the second water tubes 16 are connected to one another by the second longitudinal fin members 19. Between the first water tube array 6 and the second water tube array 17, is defined a gas flow passage 20 through which gas that has completed burning reaction flows. This gas flow passage 20 communicates with the combustion chamber 9 via the first opening 7.

In the heat transfer surface of the gas flow passage 20 on the downstream side of the gas flow passage 20, a plurality of transverse fin members 21 are provided as heat transfer fins in a multiple-stage form on the first water tubes 5 and the second water tubes 16. These transverse fin members 21 are intended to increase the amount of heat transfer in the gas flow passage 20. On the downstream side of the gas flow passage 20, gas temperature would lower so that gas volume would decrease, causing the gas flow rate to lower, resulting in a lowered amount of heat transfer as compared with the upstream side. However, by the provision of the transverse fin members 21, heat transfer area per unit space in the gas flow passage 20 is made larger on the downstream side than on the upstream side, so that the amount of heat transfer on the downstream side can be increased. Also, in the gas flow passage 20, gas temperature is the higher increasingly on the upstream side, and heat load in the first water tubes 5 and the second water tubes 16 is also the higher increasingly on the upstream side. Therefore, the transverse fin members 21 are not provided at a specified number of first water tubes 5 and second water tubes 16, as counted from the first opening 7, so that the heat load on the upstream side is prevented from increasing too high.

Above the combustion chamber 9, a burner 22 is mounted. This burner 22 is inserted at an inward center of the upper header 2 toward the combustion chamber 9. The axis line of the burner 22 and the first water tubes 5 are generally parallel to each other. The burner 22 is a burner which is used selectively switchably between liquid fuel and gas fuel. A liquid fuel supply line 23 and a gas fuel supply line 24 are connected to the burner 22. As fuel switching means, a liquid fuel valve 25 is provided on the liquid fuel supply line 23, and a gas fuel valve 26 is provided on the gas fuel supply line 24. Also, the burner 22 is equipped with a wind box 27 and a blower 28.

Whereas the burning-reaction zone is defined by the burner 22 within the combustion chamber 9, the cooling water tubes 10 are placed in a zone where the flame is present (hereinafter, referred to as "flame present zone") out of the burning-reaction zone. Also, with regard to the cooling water tubes 10, their number of tubes, heat transfer area and the like are set so that the temperature of the burning-reaction ongoing gas after contact will be not more than 1400° C.

On the outer wall 4, a chimney 29 is provided. This chimney 29 communicates with the gas flow passage 20 via the second opening 18.

In the once-through boiler of the above constitution, when the burner 22 is activated, there arises burning-reaction ongoing gas within the combustion chamber 9. In the initial stage of the burning reaction of this burning-reaction ongoing gas, fuel decomposition is performed and then the decomposed fuel reacts with oxygen vigorously. Then at the succeeding stage, such intermediate products as CO and HC that have been generated in the burning reaction above are put into further reaction, and thus burning-reaction completed gas, which has completed burning reaction, is exhausted outside as exhaust gas. In the region where the burning reaction is vigorously effected, there occurs a flame, normally.

The burning-reaction ongoing gas flows through central part of the cooling water tube array 11 nearly along its axis, as the gas expands toward the lower header 3, thus flowing into the burning-reaction continuing zone 15 through the gaps 14. Accordingly, as shown in FIG. 1, the flame is formed beyond the cooling water tube array 11 as the burning-reaction ongoing gas flows along. For this reason, the cooling water tubes 10 are located inside the flame-present zone within the burning reaction zone. Then, the burning-reaction ongoing gas that causes the flame, when passing through the gaps 14, exchanges heat with heated fluid in the cooling water tubes 10. The burning-reaction ongoing gas is rapidly cooled by this heat exchange, with the temperature lowered, by which the generation of thermal NOx is suppressed.

When the burning-reaction ongoing gas contacts the cooling water tubes 10, the burning-reaction ongoing gas is inhibited from flowing short toward the first opening 7 by virtue of the close-contact placement of the cooling water tubes 10. That is, it does not occur that a larger amount of burning-reaction ongoing gas that contacts cooling water tubes 10 located closer to the first opening 7 while a smaller amount of burning-reaction ongoing gas that contacts cooling water tubes 10 located farther from the first opening 7, but the burning-reaction ongoing gas contact the individual cooling water tubes 10 generally uniformly. Accordingly, cooling of the burning-reaction ongoing gas becomes uniform, so that increases in Nox due to generation of insufficient cooling portions are prevented, while increases in CO due to generation of excessively cooled portions are prevented.

The burning-reaction ongoing gas that has passed through the gaps 14 flows through within the burning-reaction continuing zone 15, where the burning-reaction ongoing gas makes almost no contact with any member that performs heat exchange such as the cooling water tubes 10 until reaching the first opening 7, so that the burning-reaction ongoing gas flows while holding relatively high temperature. Therefore, the burning-reaction ongoing gas flows through the burning-reaction continuing zone 15 while continuing to make burning reaction, while an oxidation reaction from CO to $CO_2$ is accelerated. In this burning-reaction continuing zone 15, besides the aforementioned oxidation reaction, oxidation reactions of the intermediate products, unburnt components of the fuel and the like are also carried out.

In order to ensure the occurrence of oxidation reaction from CO to $CO_2$ while the burning-reaction ongoing gas flows through the burning-reaction continuing zone 15, the burning-reaction ongoing gas needs to be maintained above a specified temperature and besides a reaction time more than a specified time is necessary. According to the first embodiment, by the close-contact placement of the cooling water tubes 10 placed on one side where the cooling water tubes 10 confront the first opening 7, the burning-reaction ongoing gas is prevented from being flowing short toward the first opening 7, and the burning-reaction ongoing gas flows over a relatively long distance within the burning-reaction continuing zone 15. Therefore, sufficient reaction time can be obtained so that oxidation reaction from CO to $CO_2$ can be securely produced within the burning-reaction continuing zone 15.

Then, the burning-reaction ongoing gas becomes a high-temperature gas that has nearly completed the burning reaction, flowing into the gas flow passage 20 through the first opening 7. When flowing into the gas flow passage 20, the burning-reaction completed gas is diverted into two directions. During the passage of the burning-reaction completed gas through the gas flow passage 20, heat is transferred to heated fluid within the first water tubes 5 and the second water tubes 16, so that the temperature of the burning-reaction completed gas lowers on the downstream side more and more. In the gas flow passage 20, because the transverse fin members 21 are provided on the downstream-side first water tubes 5 and second water tubes 16, the amount of heat transfer on the downstream side is increased, so that the boiler efficiency is improved. Besides, because no transverse fin members 21 are provided on the upstream-side first water tubes 5 and the second water tubes 16, the amount of heat transfer on the upstream side is prevented from become excessively high, and heat loads of the first water tubes 5 and the second water tubes 16 are averagely balanced so that overheating of the water tubes can be prevented.

Further, upon the inflow of the burning-reaction completed gas into the gas flow passage 20, even if the burning-reaction ongoing gas partly remains, the gas temperature would not lower excessively, so that enough temperature to cause oxidation reaction from CO to $CO_2$ can be ensured. Accordingly, upstream portion of the gas flow passage 20 serves also for the function of the burning-reaction continuing zone 15, thus effective for CO reduction. The burning-reaction completed gases that joined at the second opening 18 are exhausted outside as exhaust gas through the chimney 29.

The heated fluid in the cooling water tubes 10, the first water tubes 5 and the second water tubes 16 goes up while being heated, and is then taken out as steam from the upper header 2.

The once-through boiler of the above first embodiment is explained further concretely. This first embodiment example is embodied as a once-through boiler having an evaporation amount of 3000 kg per hour. The outer diameter of the cooling water tubes 10, the first water tubes 5 and the second water tubes 16 is about 60 mm. The temperature of the flame produced from the burner 22 is about 1800° C., and the temperature of the flame is lowered to about 1100° C. by the cooling with the cooling water tubes 10. This temperature is lower than the temperature (about 1400° C.) at which the amount of thermal NOx generation is substantially lowered. As a result of this, the once-through boiler can be provided as one of less NOx emission. In addition, the NOx emission of the once-through boiler of the first embodiment is about 30 ppm equivalent to 0% $O_2$. Besides, the temperature is higher than the temperature (about 800° C.) at which the oxidation reaction from CO to $CO_2$ is carried out vigorously. Therefore, while the burning-reaction ongoing gas flows through within the burning-reaction continuing zone 15, the oxidation reaction from CO to $CO_2$ is carried out vigorously, thus allowing the once-through boiler to be a once-through boiler involving less CO emission. The CO emission amount of the once-through boiler of the above first embodiment is about 15 ppm. Besides, the boiler efficiency of the once-through boiler of the first embodiment is about 90%.

As seen above, in the once-through boiler of the first embodiment, the temperature of burning-reaction ongoing gas that has flowed out from the gaps 14 of the cooling water tube array 11 is controlled to about 1100° C. However, it should be controlled to within a range of 800 to 1400° C. depending on the degree to which NOx reduction and CO reduction are required. In this connection, the temperature of burning-reaction ongoing gas that flows out from the gaps 14 is preferably as low as possible in terms of the NOx reduction, while it is preferably as high as possible in terms of the CO reduction. From this point of view, the temperature is more preferably set within a range of 900 to 1300° C.

The burner 22 is not limited to burner of any specific type, but may be burner of various types. For example, the burner 22 may be premixing type burner or diffuse-combustion type burner or other various types of burners such as vaporizing-combustion type burner.

Figure 3:
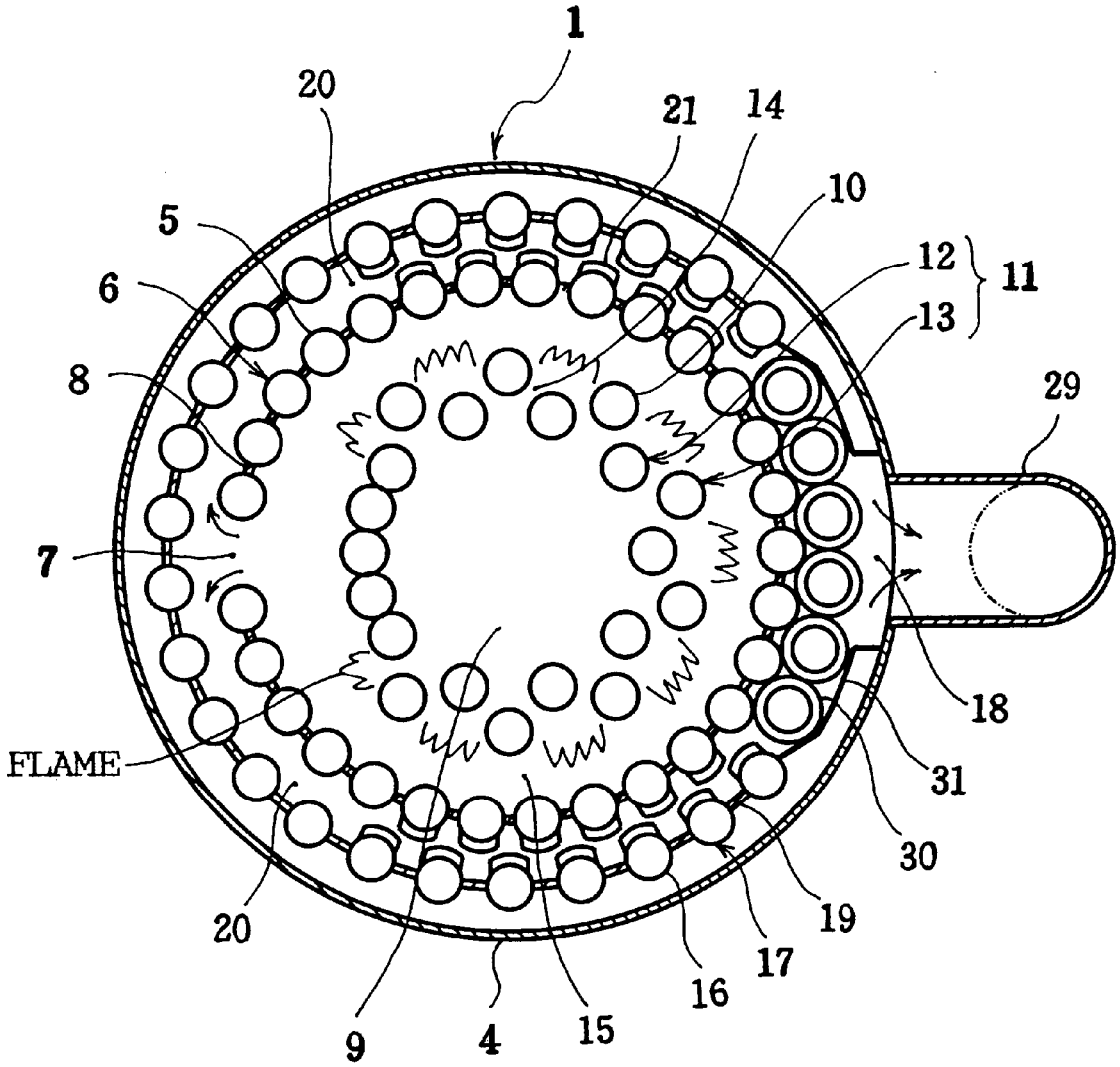
FIG. 3 is an explanatory view of a cross section in a second embodiment of the invention, similar to FIG. 2.
Figure 4:
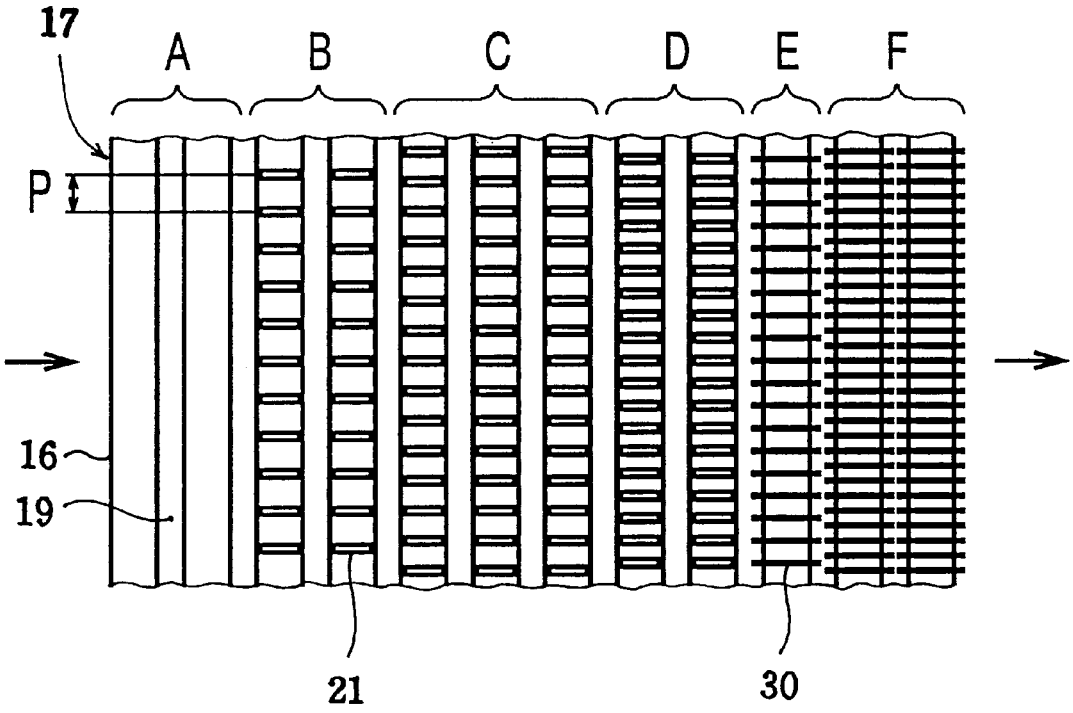
FIG. 4 is an explanatory view schematically showing the second water tube array as viewed from the gas flow passage side in FIG. 3.

Next, a second embodiment of the present invention is described with reference to FIGS. 3 and 4. The same constituent members as in the first embodiment are designated by like reference numerals and their detailed description is omitted. FIG. 3 is an explanatory view of a cross section, and FIG. 4 schematically shows the second water tube array 17 as viewed from the gas flow passage 20 side in FIG. 3.

In this second embodiment, transverse fin members 21 and all-around fin members 30 are provided as the heat transfer fins, and heat transfer area per unit space in the gas flow passage 20 is set in six steps. Referring to the second water tube array 17, there are provided, as listed in order from the upstream side, a first heat transfer portion A comprised of second water tubes 16 with no heat transfer fins provided, a second heat transfer portion B comprised of second water tubes 16 with the transverse fin members 21 provided and located at a pitch P, a third heat transfer portion C comprised of second water tubes 16 with the transverse fin members 21 provided and located at a pitch 0.8 P, a fourth heat transfer portion D comprised of second water tubes 16 with the transverse fin members 21 provided and located at a pitch 0.6 P a fifth heat transfer portion E comprised of second water tubes 16 with the all-around fin members 30 provided and located at a pitch 0.6 P and a sixth heat transfer portion F comprised of second water tubes 16 with the all-around fin members 30 provided and located at a pitch 0.4 P. The second water tubes 16 with the all-around fin members 30 provided are not connected to one another, and the burning-reaction completed gas will contact their all-around surfaces. Further, the second water tubes 16 with the all-around fin members 30 provided are equipped with a cover member 31.

In the second embodiment, the heat transfer area per water tube is changed by changing the pitch at which the transverse fin members 21 and the all-around fin members 30 are placed. Otherwise, while the pitch of their placement is constant, the heat transfer area per water tube of the heat transfer fins may be changed by changing the height of the transverse fin members 21 and the all-around fin members 30 in a direction vertical to the circumferential surfaces of the water tubes.

The transverse fin members 21 are provided also on the gas flow passage 20 side of the first water tubes 5, and their pitches of placement are set in correspondence to their confronting second water tubes 16. In order to adjust the heat transfer area per unit space, the heat transfer fins are not provided on first water tubes 5 confronting the second water tubes 16 equipped with the all-around fin members 30 provided.

By setting the heat transfer area per unit space in the gas flow passage 20 into six steps, the heat transfer area is increased according to the degree of decrease in the temperature of the burning-reaction completed gas, so that the overall gas flow passage 20 can be made into a heat transfer surface of low pressure loss and high heat transfer efficiency. Therefore, the boiler efficiency is greatly improved. Also, the difference in heat load in the first water tubes 5 and the second water tubes 16 becomes smaller. Since the constitution of the cooling water tube array 11 is similar to that of the first embodiment, the same effects of NOx reduction and CO reduction as in the first embodiment can be obtained.

Figure 5:
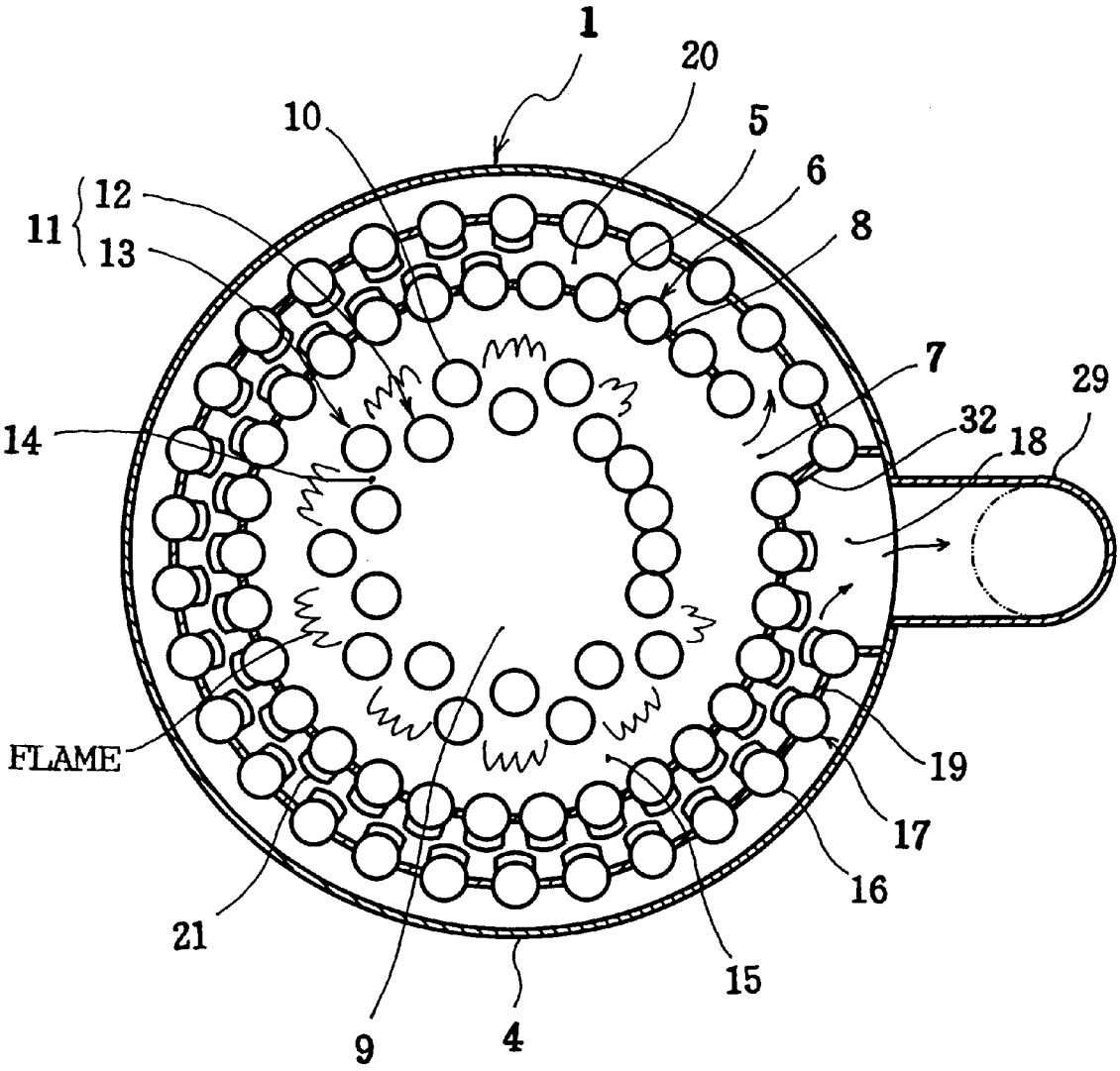
FIG. 5 is an explanatory view of a cross section in a third embodiment of the invention, showing an arrangement example of the gas flow passage.

Further, a third embodiment of the invention is described with reference to FIG. 5. The same constituent members as in the first embodiment are designated by like reference numerals and their detailed description is omitted. In this third embodiment, the gas flow passage 20 is not branched in two directions, but flows in one direction only. The first water tube array 6 and the second water tube array 17 are joined together by a partitioning wall member 32 at near the first opening 7, so that the gas flow passage 20 starts at one side of the partitioning wall member 32 and ends at the other side, running around the outside of the first water tube array 6.

In the gas flow passage 20, as in the first embodiment, the first water tubes 5 and the second water tubes 16 on the upstream side are not equipped with the transverse fin members 21, and the first water tubes 5 and the second water tubes 16 on the downstream side are equipped with the transverse fin members 21, so that the heat transfer area per unit space is larger on the downstream side than on the upstream side. Therefore, improvement in the boiler efficiency as well as averaged balance of heat loads of the individual water tubes by virtue of the increase in heat transfer amount on the downstream side can be achieved. Further, since the constitution of the cooling water tube array 11 is similar to that of the first embodiment, the same effects of NOx reduction and CO reduction as in the first embodiment can be obtained.

As shown hereinabove, according to the present invention, there can be provided a water-tube boiler which is capable of achieving further NOx reduction and CO reduction with a simple constitution of the boiler body itself and which is clean in exhaust gas in response to environmental issues. Besides, by virtue of contrivances for the heat transfer surfaces, the water-tube boiler is greatly improved in boiler efficiency, thus greatly contributing to energy saving.

What is claimed is:

1. A water-tube comprising:

a first water tube array made up of a plurality of first water tubes arranged into an annular shape;

a combustion chamber defined inside the first water tube array;

a first opening defined at part of the first water tube array;

a cooling water tube array made up of a plurality of cooling water tubes arranged into an annular shape in a zone within the combustion chamber where burning-reaction ongoing gas is present;

gaps provided between adjacent cooling water tubes so as to permit the burning-reaction ongoing gas to flow through;

a burning-reaction continuing zone, where burning reaction is continuously effected, provided between the cooling water tube array and the first water tube array;

a second water tube array made up of a plurality of second water tubes arranged into an annular shape outside the first water tube array;

a second opening defined at part of the second water tube array; and a gas flow passage provided between the first water tube array and the second water tube array.

2. The water-tube boiler according to claim 1, wherein in the gas flow passage, heat transfer fins are provided on heat transfer surfaces on the downstream side while the heat transfer fins are not provided on heat transfer surfaces on the upstream side.

3. The water-tube boiler according to claim 1, wherein in the gas flow passage, heat transfer fins are provided on at least one of the first water tubes and the second water tubes, and heat transfer area per water tube of the heat transfer fins on the downstream side is larger than heat transfer area per water tube on the upstream side.

4. The water-tube boiler according to claim 1, including transverse fin members operatively connected to the tubes of the first water tube array.

5. The water-tube boiler according to claim 4, further including surrounding fin members for transferring heat.

6. The water-tube boiler according to claim 5, wherein the pitch of the transverse fin members and the surrounding fin members varies.

7. The water-tube boiler according to claim 1, further including a wall member joining the first and second tube arrays.

* * * * *